United States Patent [19]

Agostinelli

[11] 4,192,226

[45] Mar. 11, 1980

[54] PAPER LOG ROLLER

[76] Inventor: Agostino Agostinelli, P.O. Box 244, Westbrook, Conn. 06498

[21] Appl. No.: 912,008

[22] Filed: Jun. 2, 1978

[51] Int. Cl.[2] ..... B31C 1/00

[52] U.S. Cl. ..... 93/1 C; 242/671 R; 100/76

[58] Field of Search ..... 93/1 C, 81 R; 242/67.1 R, 67.3, 75.4, 55.2, 75.2; 100/76; 44/2

[56] References Cited

U.S. PATENT DOCUMENTS

| | | | |
|---|---|---|---|
| 649,694 | 5/1900 | Hunter | 242/67.1 R |
| T 901029 | 8/1972 | Thompson | 242/67.1 |
| 2,567,049 | 9/1951 | Belluche | 242/75.2 |
| 3,191,882 | 6/1965 | Riedel | 242/67.3 R |
| 3,698,655 | 10/1972 | Chang | 242/75.2 |
| 4,039,299 | 8/1977 | Porter et al. | 44/2 |
| 4,059,211 | 11/1977 | Brizzolara | 242/67.3 R |
| 4,068,564 | 1/1978 | Dahlstrom | 93/1 C |

FOREIGN PATENT DOCUMENTS

| | | | |
|---|---|---|---|
| 1426308 | 12/1966 | France | 242/67.1 R |
| 132197 | 9/1919 | United Kingdom | 242/67.3 R |

*Primary Examiner*—Robert Louis Spruill
*Assistant Examiner*—K. Y. Lin
*Attorney, Agent, or Firm*—C. G. Nessler

[57] ABSTRACT

An apparatus capable of forming flexible sheet material such as newspaper rolls suitable for combustion in a fireplace or the like is disclosed. The apparatus includes a deflectable table and an idler bar, both adapted for bearing against the roll as it is formed, to facilitate feeding the sheet to form the roll and to smooth and compact the roll, a rotating shaft about which the roll is formed, and a frame to secure the shaft, table and idler arm.

6 Claims, 7 Drawing Figures

PAPER LOG ROLLER

BACKGROUND OF THE INVENTION

This invention relates to an apparatus for forming flexible sheet material into rolls, and more particularly to an apparatus for forming newspaper sheets into log shaped rolls having a density capable of providing even combustion for a long duration.

Firm rolls of combustible paper sheet material, commonly called paper logs, are used instead of fuel wood logs in fireplaces and stoves. Combustion of paper logs provides a means of disposing of unwanted waste, conserves costlier or scarcer wood, and provides a means for recycling a waste material into energy. Paper logs, when formed and compacted evenly, can be readily handled and stored, and can provide stable combustion over a prolonged period of time, as compared to the typical flash combustion produced by separated loose sheet, or the unsustained combustion produced by combustible sheet material formed into objects of exceptionally high density, as for instance, a book.

Apparatus for forming flexible sheet material into rolls capable of providing combustion are known in the art. The simplest apparatus for forming paper logs includes a hand cranked shaft rotated in a simple supporting frame. Devices such as this are deficient for forming paper logs having a density which gives even burning because there are no means for compacting or smoothing the roll; this must be accomplished intermittently and manually by the operator. To permit engagement of discontinuous sheets into the roll, and to produce a roll which will maintain its integrity upon removal, it is necessary that sheets be interleaved. With apparatus heretofore known in the art, interleaving of discontinuous sheets is difficult; as one sheet is drawn about the roll, the following sheet must be awkwardly placed within the intersection of the unrestrained trailing edge of the sheet and the outer surface of the roll. In some instances a liquid such as water or hydrocarbon is integrated into the sheet while it is formed into a roll, to either facilitate compaction and integrity of the roll upon its removal from the apparatus, or to provide a combustible residue. The use of a liquid is messy and awkward, and in the case of water, necessitates drying the log before use.

Wolk, in U.S. Pat. No. 3,033,481, filed Feb. 28, 1961, describes a handcranked device for reeling continuous paper tape into a roll formed about a shaft. The device has spring-actuated side plates which serve to even the length of the paper roll by pressing on the cylindrical ends of the roll. Control of the longtitudinal dimension through the spring actuated plates does not have any beneficial effect on the diametrical compaction. Control of the diametrical compaction only results from the tension force in the sheet being wound, which is not controlled by the apparatus.

Christen, Jr. et al. in U.S. Pat. No. 3,964,373 filed Mar. 19, 1975, describe a device having a split-cylinder tray. The tray partially surrounds the handcranked shaft and forms a space which is filled as the sheet is accumulated as a roll about the shaft. Contained within the tray are elongated leaf springs which bear circumferentially against the outer diameter of the roll being formed. The tray only serves the purpose of containing the springs and does not otherwise aid compaction or feeding of sheet into roll.

Butz in U.S. Pat. No. 3,936,007, filed Oct. 3, 1974, discloses an apparatus having a handcranked roll-forming shaft, the ends of which are rotatably mounted in slidable end pieces moving in guides perpendicular to the base. The shaft is thus permitted to translate in a plane perpendicular to the base, opposed by springs within the end piece guides. As a result, when the paper roll is accumulated on the shaft, the outer surface of the roll presses on the base, thereby tightening and compacting the roll. Due to the translation which the shaft undergoes, the device is not readily adapted to being powered by a motor; continuous interleaving and roll formation are not easily achieved by a sole operator.

In the foregoing and other apparatuses, where there is no provision for smoothing the roll, special skill in careful feeding and manual smoothing on the part of the operator is needed to achieve a uniform, smooth, and evenly combusted roll. Where no provision is made for easily interleaving discontinuous sheets, either the operation must be intermittent and the formation of a roll thereby slowed, or an assistant must be employed to help the operator feed the sheets or turn the crank.

SUMMARY OF THE INVENTION

A principle object of the present invention is to simply form sheet material into rolls capable of being uniformly consumed in a combustion process. Another object of the present invention is to facilitate the feeding of discontinuous sheets while forming them into rolls.

The present invention includes an improved apparatus capable of forming sheets of combustible material into rolls, which is comprised of: a frame; a rotatable shaft mounted in the frame, adapted for receiving and accumulating sheets of flexible material; drive means for rotating the shaft; a deflectable table adapted for receiving and feeding sheets onto the shaft, and compacting and smoothing sheet accumulated as a roll about the shaft, and; an idler bar adapted for smoothing and compacting the roll.

A feature of the invention is that the deflectable table is spring tensioned and continuously presses against the outer surface of the roll as it accumulates; the table also maintains itself tangent to the roll surface to allow the feeding and interleaving of sheet onto the roll. Another feature of the invention is that the idler bar is spring tensioned so that it presses continuously against the exterior surface of the roll.

An advantage of the invention is that discontinuous or partial sheets are easily received and interleaved into a roll by a sole operator. Another advantage is that rolls are compacted and smoothed continuously as they are formed, and that the compacting and smoothing force increases as the size of the roll increases.

A further advantage of the apparatus is that it is adapted to forming continuous or discontinuous sheets of similar or varying sizes and thicknesses into rolls, without the use of any adhesives or liquids or other compaction aids.

An additional advantage is that rolls of sheet produced by the apparatus due to their compaction and interleaving, maintain their integrity upon removal from the apparatus and resist the tendency to become unrolled, and that the rolls will be capable of providing even burning characteristics.

The foregoing, and other objects, features and advantages of the present invention will become more apparent in the light of the following detailed description of the preferred embodiment thereof as shown in the accompanying drawings.

DESCRIPTION OF THE PREFERRED EMBODIMENT

Figure 1:
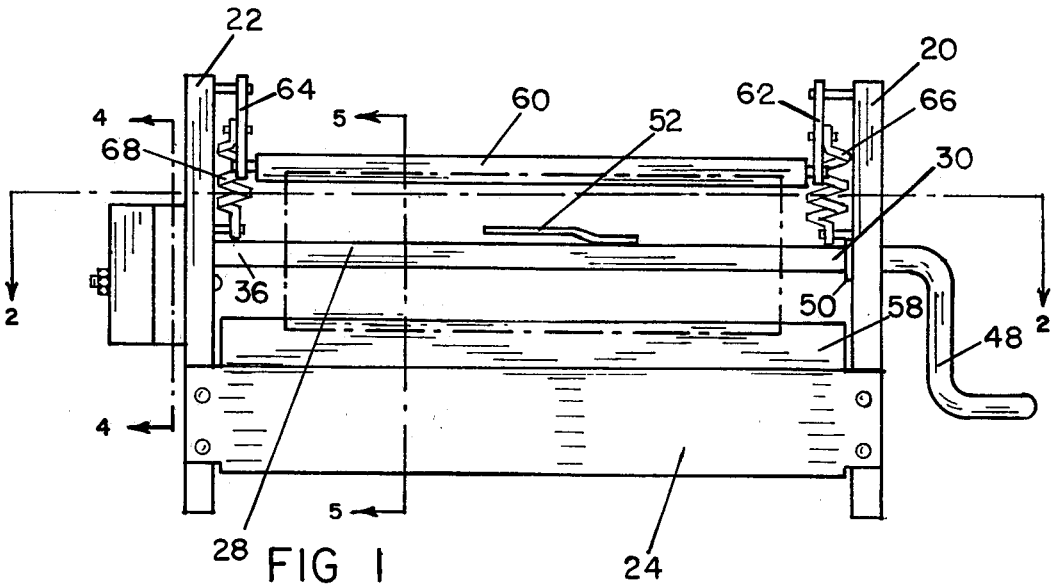
FIG. 1 is a front elevation view of the preferred embodiment of the invention, showing in phantom lines a formed roll.
Figure 2:
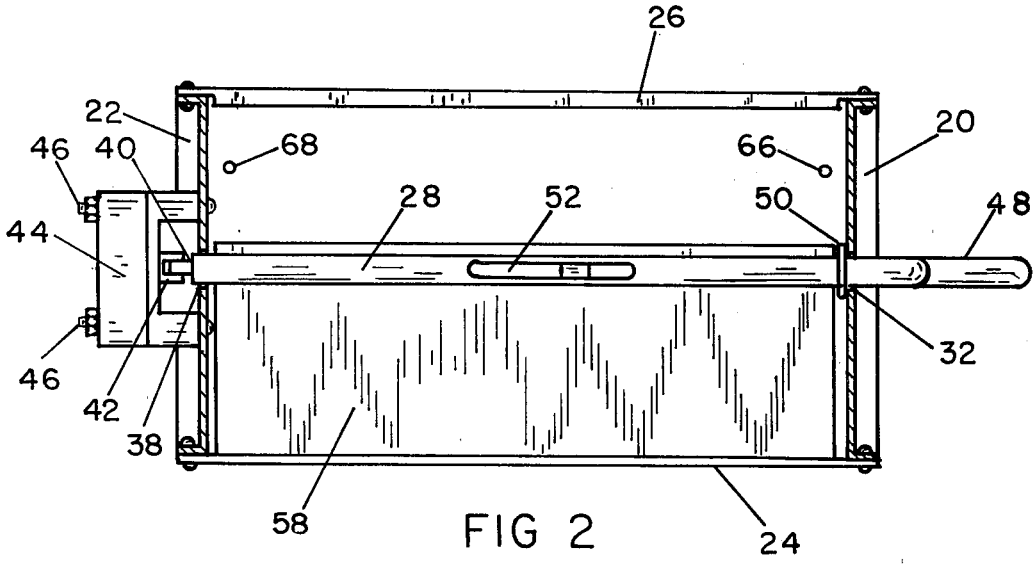
FIG. 2 is a sectional plan view of FIG. 1 along line 2—2
Figure 3:
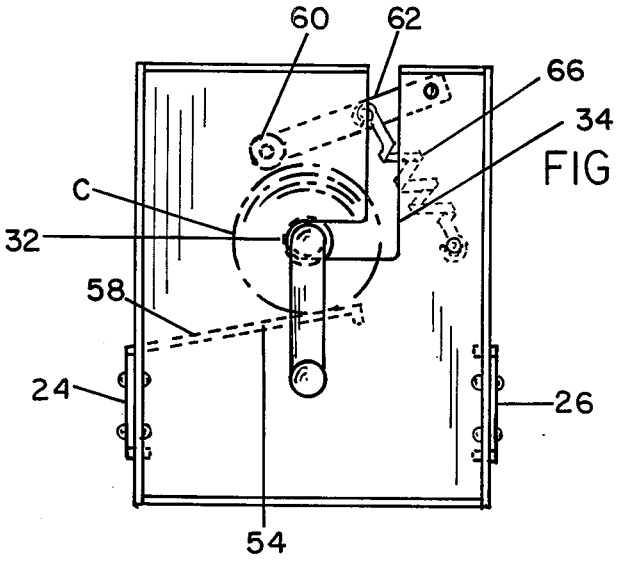
FIG. 3 is an end elevation view of FIG. 1

The invention, as shown in FIGS. 1 and 2, is an apparatus for forming sheet material into rolls capable of being combusted uniformly. The apparatus has a first end frame 20 and a second frame 22, rigidly interconnected and spaced apart by a front strut 24 and a rear strut 26. The bottoms of said end frames comprise the base upon which the apparatus rests on a flat surface. A shaft 28 is rotably and removably mounted horizontally between the first and second frames, 20 and 22, such that its first end 30 is mounted in a receptacle which is the semi-circular shaped point 32 of an elongated L-shaped slot 34 in the first end frame, as shown in FIG. 3, and; such that its second end 36 is mounted in a receptacle which is the bearing hole 38 in the second end frame 22. The bearing hole 38 is in alignment with the semi-circularly shaped termination point 32. The shaft is adapted to receive and accumulate sheet material into a roll C, shown in phantom outline, in a manner which is described below.

Figure 4:
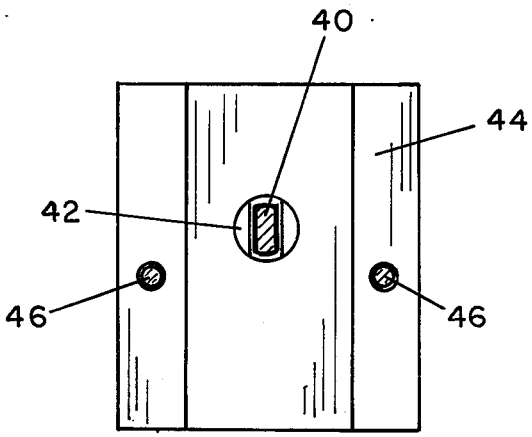
FIG. 4 is an end sectional view of FIG. 1 along line 4—4

The second end 36 of the shaft projects longitudinally beyond the second end frame and terminates in a stub 40 having a rectangular cross section. The stub of the shaft is releasably and coaxially engaged with a motor drive shaft 42 having a mating rectangular cross section slot, as shown in FIG. 4. The drive shaft is connected to and capable of being rotated by a motor 44 which is mounted on the second end frame with bolts 46. The first end 30 of the shaft projects longitudinally through the slot termination point 32 in the first end frame 20 and terminates in a crank handle 48. A bushing 50 is fixed to the shaft along its first end 30 and slidably bears against the interior surface of the first end frame, preventing substantial longitudinal motion of the shaft toward the first end frame. A bent shaped cantilevered clip 52 is fixed to the shaft 28 centrally between its first end and its second end so that the cantilevered end of the clip is spaced apart from and parallel to the longitudinal axis of the shaft and so that it projects toward the second end of the shaft.

Figure 5:
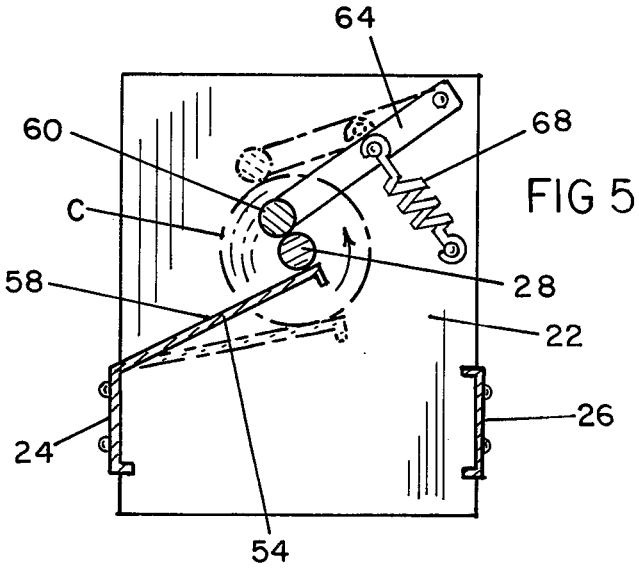
FIG. 5 is an end cross sectional view of the apparatus showing the position of the elements prior and subsequent to the formation of a roll.

A table 54, rectangular in shape, is affixed along one edge to the front strut 24 at a point below the horizontal plane of the shaft 28. The table is cantilevered angularly upward toward the horizontal plane of the shaft, and extends slightly beneath and tangentially beyond the shaft, and terminates in a folded edge 56, as shown in FIG. 5. The table 54 is fabricated of a material which has suitable elasticity and thickness to hold its static position and to also allow the table to elastically and resistively move apart from shaft 28 when force is applied to either the table edge 56 of upper surface 58. As will be described below, the table surface 58 bears on the roll C as it is formed, and the frictional interaction between the table surface and the roll and sheet being formed is useful. Therefore the table surface 58 may have applied to it varied materials or textures, such as Teflon polymer, sandpaper, knurling, or peening, to either decrease or increase the frictional force produced by the normal finish of the table material.

An idler bar 60 is rotatably mounted parallel to the shaft 28 between the end of the first strut 62 and the end of a second strut 64. The first and second struts are pivotally mounted at their opposing ends on the first and second end frames respectively. The struts are connected at their mid-points to their respective end frames with coil springs 66 and 68. The idler bar is positioned closely to the shaft 28 so that translative motion of idler bar away from the shaft is resistively opposed by the elastic force of the springs.

Figure 6:
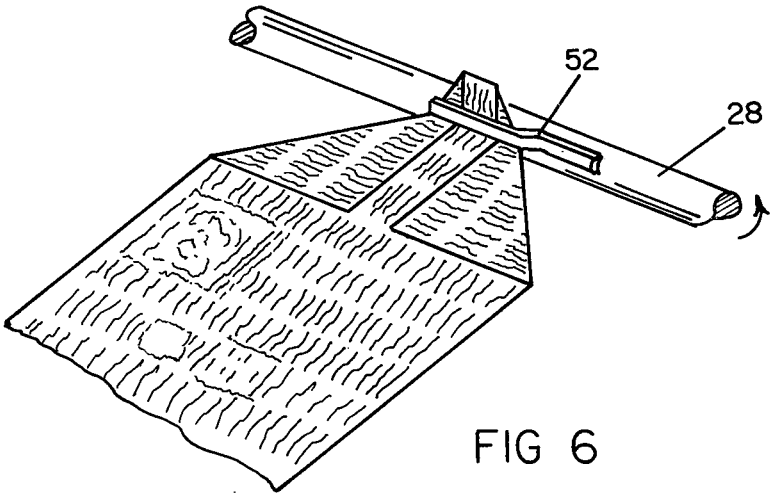
FIG. 6 is a segmental view of the apparatus showing the edge of a sheet is folded and engaged with a clip.

In operation, the shaft 28 is rotated by either manual operation of the crank handle 48 or powered operation of motor 44. The edge of a sheet is folded and engaged with clip 52 as shown in FIG. 6. Rotary motion of the shaft in a counter clockwise direction, as viewed from the first end 30 of the shaft, causes the sheet to be drawn circumferentially about the shaft and across the surface 58 of the table 54. Continued rotation will cause the accumulation of sheet and result in the formation of a roll C. The table 54 is positioned to contact and yieldably press against the lower surface of a roll as it forms about the shaft. The increasing diameter of the roll causes the table edge 56 to be moved increasingly away from the shaft and results in increasing force on the roll C. And of course, as the table is forced to comply with the increasing diameter of the roll it will be caused to curve downward from its original position, as this is the nature of bending which a cantilevered member will undergo. This increasing force imparts a frictional resistive force to the sheet as it passes across the table surface 58, causing a tension in the sheet as it is wound about the roll and thereby creating a compact roll. It is also observed that the frictional resistive force of sheet passing across the table surface will hold the first end 30 of the shaft laterally in its bearing place at the slot termination point 32. Sheet which is accumulatively drawn onto the shaft passes circumferentially around the roll and beneath the idler bar 60. The increasing diameter of the roll causes the idler bar to move increasingly away from the shaft and results in increasing force on the roll C. The elastically tensioned table 54 and idler bar 60 smooth and compress the sheet as it is wound about the shaft and apply increasing compacting force as the diameter of the roll increases and its surface area becomes greater, thereby sustaining the effect. The elastic tension of idler bar and table, and therefore the compaction of the roll, may be varied by adjustment of the springs of the idler bar or by changing the initial position or sectional modulus characteristics of the table. It is also seen that the table and idler bar will yieldably move if a relatively incompressible foreign object such as the operator's finger is interposed between them and the roll. It is futher evident that when local wrinkles, bumps or other protruberances occur along the surface of the roll the major part of the elastic force of the table 54 will be applied to their smoothing due to the cantilevered unity of the table and the load distributive effect of the table edge 56. In contrast to the table, the idler bar compacts the sheet through a rolling motion. The cylindrical surface of the idler bar concentrates its force in a line on the surface of the roll, and does not produce an appreciable tensioning. The use of the idler bar in conjunction with the table also balances the force on the shaft.

Figure 7:
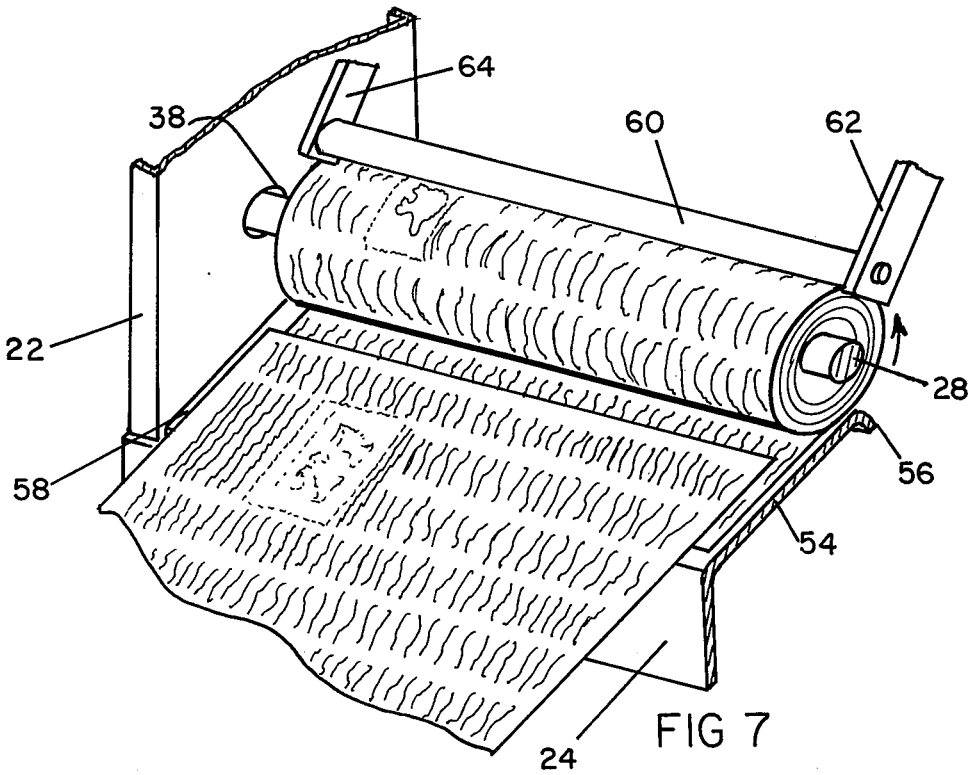
FIG. 7 is an isometric view of the apparatus showing discontinuous sheets are engaged onto the roll.

As shown in FIG. 7, discontinuous sheets are engaged onto the roll by placing the leading edge of a sheet onto the trailing edge of the preceding sheet as it is being drawn across the surface 58 of the table, so that the leading edge of the sheet intercepts the intersection of the preceding sheet and the circumferential surface of the roll. Accordingly the sheet will be frictionally engaged and incorporated into roll C. In a like manner the operator can conveniently deposit fragmentary sheets or articles upon a sheet as it passes across the table surface, and include them in the roll. It is observed that table 54 is automatically positioned to allow the ready tangential feeding of sheets onto the circumference of the roll as the roll diameter increases. The facility for readily interleaving discontinuous sheets results in a roll which has controllable density with excellent integrity and little tendency to become unwound without external fastenings. It is also observed that the operation of the apparatus, facilitated by the table 54 and the use of the motor 44, is capable of being smooth and continuous even with a sole operator and can result in the rapid creation of a roll of useful density and compactness.

When a roll of the desired diameter is formed, the rotation of the shaft 28 is ceased and the idler bar 60 is moved to a disengaged position. The crank handle 48 is moved laterally and then vertically causing the first end 30 of the shaft to move along the L-shaped slot 34 and thereby be removed from the first end frame 20. The angular motion of the shaft 28 with respect to the second end frame 22 is accomodated by clearances provided at the bearing hole 38 in the second end frame 22 and at the motor drive shaft 42 and stub 40 engagement. Once the crank handle and first end 30 of the shaft are removed from the end frame, the shaft is pulled longitudinally away from the second end frame and thereby freed from it. Thereafter the shaft can be withdrawn from the roll by pulling longitudinally on the crank handle while restraining the roll. The roll can then be combusted or stored as desired.

As mentioned, the elastic tension in the idler bar and table may be changed to vary the desired compaction. Thus, it should be evident that if the tension in the table is suitably increased, the idler bar tension may accordingly be decreased. The idler bar tension therefore may be decreased to zero, given the appropriate table tension. And in such instance, the idler bar may be dispensed with. Of course, the converse is not true, since the table is necessary for feeding of the sheet onto the roll.

Although the invention has been shown and described with respect to a preferred embodiment thereof, it should be understood by those skilled in the art that various changes and omissions in form and detail thereof may be made therein without departing from the spirit and scope of the invention.

I claim:

1. An improved method forforming discontinuous flexible sheet into a roll with an apparatus wherein a first sheet has been partially formed into the roll about a shaft adapted to be rotated and wherein said sheet has a trailing edge, which comprises, providing a cantilevered table in a position which contacts the roll and which supports the trailing edge of the first sheet; placing the leading edge of a second sheet on the trailing edge of the first sheet so that the leading edge intercepts the intersection of the first sheet and the circumferential surface of the roll being formed;

frictionally engaging the second sheet by rotation of the shaft;

tensioning and pressing on the first and second sheet formed about the shaft with the cantilevered table to tension and compact the roll; and continuing to position second sheets upon the preceeding sheets in like manner until a roll of the desired size is accumulated.

2. The method of claim 1, including the further step of pressing on the first and second sheet as they are formed about the shaft with an idler bar.

3. The method in claim 1 where the table has a surface of controlled frictional character where it contacts the sheet formed into a roll about the shaft.

4. Apparatus adapted to form discontinuous flexible sheets into a roll, said apparatus having a first end frame provided with a receptacle for receiving the first end of a shaft, rigidly interconnected with a second end frame having a receptacle for receiving the second end of a shaft, a shaft rotatably and removeably mounted between the first and second end frame, said shaft being adapted for receiving and engaging a sheet, and a means for rotating the shaft, the improvement comprising an elastically deflectable cantilevered table mounted between the end frames, the table having a free and unattached end adapted to press against the roll formed about the shaft and a fixed end adapted to receive and allow the passage of sheets toward the free end, the table further being adapted to support the trailing edges of a first sheet while the leading edge of a second sheet is placed thereon.

5. The apparatus of claim 4, further comprising a rotatable idler bar positioned between the end frames with its longitudinal axis parallel to the shaft, the bar being resistively translative apart from the shaft in a direction which imparts a force to the roll in opposition to the force imparted by the table, to smooth and compact the roll and balance the force on the roll caused by the table.

6. The apparatus in claim 4, wherein the first end frame contains an L-shaped slot adapted to receive one end of the shaft to allow removal of the shaft from the end frame, the L-shaped slot being oriented so that the slot entry end is at an edge of the end frame and the slot termination point is positioned so that force on the shaft caused by frictional force on the roll from the table draws the shaft against the slot termination point.

* * * * *